10/8/85 XR 4,545,926

United States Patent [19]

Fouts, Jr. et al.

[11] Patent Number: 4,545,926

[45] Date of Patent: Oct. 8, 1985

[54] CONDUCTIVE POLYMER COMPOSITIONS AND DEVICES

[75] Inventors: Robert W. Fouts, Jr., Redwood City; Andrew N. S. Au, Fremont; Burton E. Miller, Sunnyvale; Alan J. Gotcher, Saratoga, all of Calif.

[73] Assignee: Raychem Corporation, Menlo Park, Calif.

[21] Appl. No.: 141,991

[22] Filed: Apr. 21, 1980

[51] Int. Cl.[4] ..... H01B 1/06

[52] U.S. Cl. ..... 252/511; 252/502; 252/503; 252/506; 252/508; 252/512; 252/513; 252/514; 252/515; 523/137; 524/439; 524/440; 524/441; 524/495; 524/496; 524/420; 524/492

[58] Field of Search ..... 252/511, 512, 513, 514, 252/515, 502, 503, 508, 506; 524/495, 496, 439-441, 420, 492; 523/137

[56] References Cited

U.S. PATENT DOCUMENTS

| | | | |
|---|---|---|---|
| 2,795,680 | 6/1957 | Peck | 201/63 |
| 2,825,702 | 3/1958 | Silversher | 252/503 |
| 3,140,342 | 7/1964 | Ehrreich | 174/35 |
| 3,278,455 | 10/1966 | Feather | 252/512 |
| 3,412,043 | 11/1968 | Gilliland | 252/514 |
| 3,571,777 | 3/1971 | Tully | 338/20 |
| 3,597,720 | 8/1971 | Burgess | 338/202 |
| 3,686,139 | 8/1972 | Lubin | 252/511 |
| 3,976,600 | 8/1976 | Meyer | 252/514 |
| 3,983,075 | 9/1976 | Marshall | 252/511 |
| 4,237,441 | 12/1980 | van Konynenburg et al. | 338/22 |
| 4,308,314 | 12/1981 | Nakano et al. | 428/323 |

FOREIGN PATENT DOCUMENTS

| | | |
|---|---|---|
| 922039 | 2/1973 | Canada . |
| 1449321 | 8/1966 | France . |
| 2405276 | 6/1978 | France . |
| 2391250 | 12/1978 | France . |
| 760499 | 10/1956 | United Kingdom . |
| 1369210 | 10/1974 | United Kingdom . |
| 1444722 | 8/1976 | United Kingdom . |
| 2000518 | 1/1979 | United Kingdom . |
| 2036754 | 7/1980 | United Kingdom . |
| 1602372 | 11/1981 | United Kingdom . |

OTHER PUBLICATIONS

J. Phys. D: Appl. Phys., vol. II, pp. 1457-1462 (1978) (Littlewood & Briggs).

NASA Technical Brief 66-10691.

NASA Report N68-35634 (1968) Shulman et al.

NASA Technical Brief 70-10383 (1970).

Iz. Vys. Uch. Zav. Kh. i Kh. Tech., vol. 21, No. 7 (1978), pp. 1078-1079.

*Primary Examiner*—Josephine L. Barr

*Attorney, Agent, or Firm*—Timothy H. P. Richardson; Herbert G. Burkard

[57] ABSTRACT

Conductive polymer compositions comprises a polymeric material having dispersed therein (a) conductive particles composed of a highly conductive material and (b) a particulate filler. The compositions exhibit a positive temperature coefficient of resistivity and undergo a large increase in resistivity as the temperature increases above a certain value. The compositions are useful in preparing electrical devices such as current limiting devices, heaters, EMI shields and the like.

49 Claims, 9 Drawing Figures

CONDUCTIVE POLYMER COMPOSITIONS AND DEVICES

BACKGROUND OF THE INVENTION

1. Field of the Invention

This invention relates to conductive polymer compositions which exhibit a positive temperature coefficient of resistivity and to electrical devices comprising said compositions.

2. Discussion of the Prior Art

Conductive polymer compositions containing particles dispersed in a polymer matrix are described in the art. The conductive particles commonly used are of carbon black. The particles are generally dispersed in crystalline thermoplastic polymers, elastomeric polymers, mixtures of one or more crystalline thermoplastic polymers with one or more elastomeric polymers, and thermosetting resins. Reference may be made, for example, to U.S. Pat. Nos. 3,823,217 (Kampe), 3,861,029 (Smith-Johannsen et al.), 3,950,604 (Penneck), and 4,177,376 (Horsma et al.) and to U.S. patent application Ser. Nos. 904,736 (Penneck et al.), 798,154 (Horsma), now abandoned, 899,658 (Blake et al.), 965,343 (Van Konynenburg et al.), now U.S. Pat. Nos. 4,237,441, 965,344 (Middleman et al.), now U.S. Pat. Nos. 4,238,812, 965,345 (Middleman et al.), now U.S. Pat. Nos. 4,242,573, 6,773 (Simon) now U.S. Pat. Nos. 4,255,698, and 75,413 (Van Konynenburg) now U.S. Pat. No. 4,304,987. The disclosures of these patents and applications are incorporated by reference herein.

Some of the conductive polymer compositions containing dispersed carbon black particles exhibit what is referred to as a positive temperature coefficient of resistance (PTC) and undergo a sharp increase in resistivity as their temperature rises above a particular value. This temperature is frequently referred to as the switching temperature or the anomaly temperature.

Conductive polymer compositions in which the conductive particles are metal powders, particles or flakes, are also disclosed in the art. These compositions generally have low resistivity, depending on the amount and characteristics of the metal particles incorporated into the polymer. Some of these compositions are reported to be PTC materials and their use in current limiting or current interrupting devices has been proposed. However, the use of these compositions is limited by internal arcing which can lead to catastrophic failure of the device and in some cases, complete burning of the device. In J. Phys. D: Appl. Phys. Vol. II, 17, Littlewood and Briggs report an investigation into the use of metal-filled epoxy resins in current interrupting devices. They report that damage due to internal arcing renders the device unsuitable for use at voltages greater than 10 volts.

In "Solid State Bistable Power Switch" by Shulman et al., National Aeronautics and Space Administration Report N68-35634 (1968), a study on a resettable fuse for high current applications is reported. The resettable fuse comprises metal particles dispersed in a polymer matrix comprising a silicone resin. It is reported that when a polyester material was used as the matrix, the device exploded after several successful trips. It was also found that in order for the fuse to be capable of being used at relatively high currents, the metal particles should be relatively large, about 20 mesh (about 850 microns). When smaller particles (325 mesh) were used in the device, high currents caused the particles to melt and fuse together. The resettable fuse of Shulman et al. indefinitely remains in the state into which it was last switched. Thus, when the device has tripped, that is, has switched into its high resistance state, it remains in that state until it is reset. To reset the device i.e., switch it back to its low resistance state, it must be subjected to a relatively high reset voltage pulse.

U.S. Pat. No. 3,983,075 (Marshall) discloses electrically conductive compositions comprising copper flakes dispersed in an epoxy resin binder. The compositions are used to make heaters. To improve uniformity between different batches of the conductive composition when the composition contains less than 50% by weight copper flake, carbon black in an amount of 5-10% by weight is added. The conductive compositions of Marshall are not PTC materials, as discussed in greater detail in the comparative example below. The U.S. Pat. No. 3,983,075 also reports that local overheating results in thermal degradation of the composition. The incorporation of carbon black is said to avoid local sparking by lowering the resistance between adjacent flakes.

SUMMARY OF THE INVENTION

It has now been discovered that conductive polymer compositions which contain conductive particles of metals or other highly conductive materials, which exhibit anomalous PTC behavior, as more fully defined hereinafter, and which are capable of withstanding voltages above 10 volts can be prepared by dispersing conductive particles, such as metal particles, and a particulate filler in a polymeric material.

In one aspect the invention provides a conductive polymer composition comprising a polymeric material having dispersed therein:

(a) at least about 10% by volume, based on the total volume of the composition, of conductive particles composed of a material having a resistivity at 25° C. of less than $10^{-3}$ ohm-cm; and (b) at least about 4% by volume, based on the total volume of the composition, of at least one particulate filler;

said composition exhibiting (i) a volume resistivity of less than $10^5$ ohm-cm at a temperature in the range of from about −40° C. to $T_s$, where $T_s$ is the switching temperature of the composition, and (ii) a positive temperature coefficient of resistivity such that the ratio of the resistivity of the composition at a temperature in the range of from $T_s$ to [$T_s$+100° C.] to the resistivity at a temperature in the range of from −40° C. to $T_s$ is at least 1000, with the proviso that when the particulate filler (b) is composed of metal particles, the average particle size of the particulate filler (b) is substantially smaller than the average particle size of said conductive particles (a).

Another aspect of this invention comprises an electrical device comprising at least one electrode in electrical contact with a conductive polymer composition comprising a polymeric material having dispersed therein:

(a) at least about 10% by volume, based on the total volume of the composition, of conductive particles composed of a material having a resistivity at 25° C. of less than $10^{-3}$ ohm-cm; and (b) at least about 4% by volume, based on the total volume of the composition, of at least one particulate filler;

said composition exhibiting (i) a volume resistivity of less than $10^5$ ohm-cm at a temperature in the range of from about −40° C. to $T_s$ where $T_s$ is the switching temperature of the composition, and (ii) a positive temperature coefficient of resistivity such that the ratio of the resistivity of the composition at a temperature in the range of from $T_s$ to [$T_s$+100° C.] to the resistivity at a temperature in the range of from −40° C. to $T_s$ is at least 1000. with the proviso that when the particulate filler (b) is composed of metal particles, the average particle size of the particulate filler (b) is substantially smaller than the average particle size of said conductive particles (a).

DETAILED DESCRIPTION OF THE INVENTION

Figure 1:
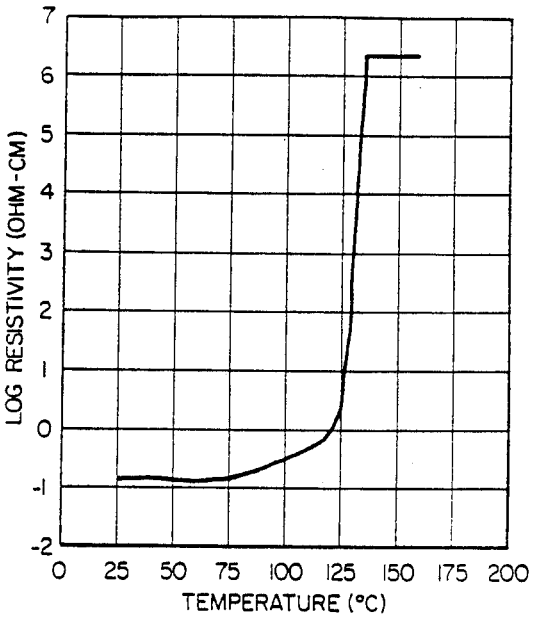
FIGS. 1–8 show the resistivity-temperature characteristics of exemplary compositions of this invention.
Figure 2:
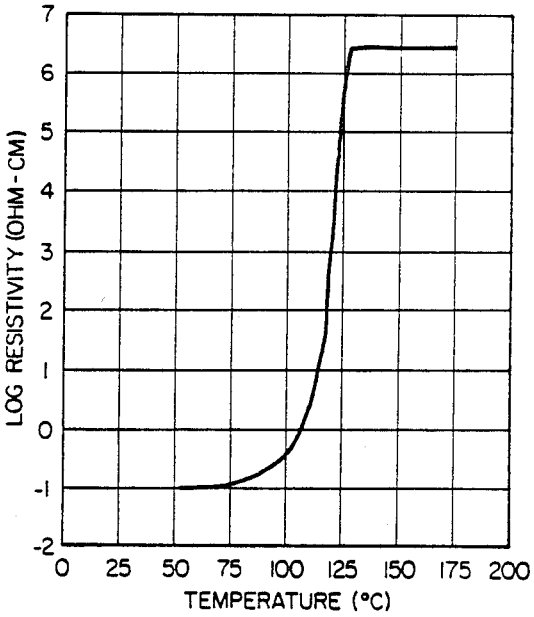
Figure 3:
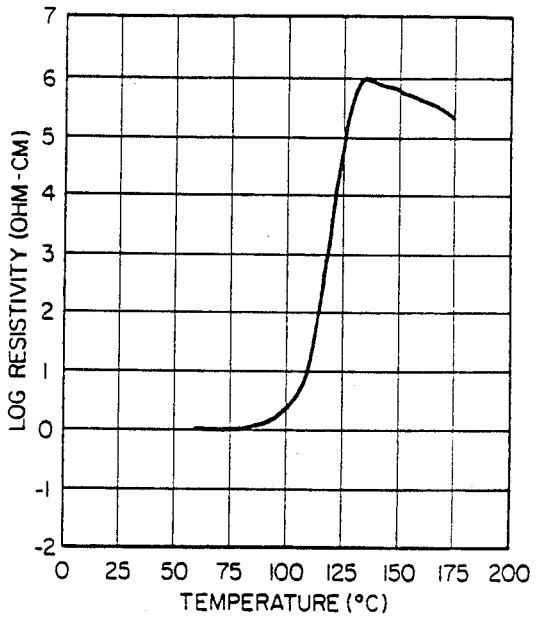
Figure 4:
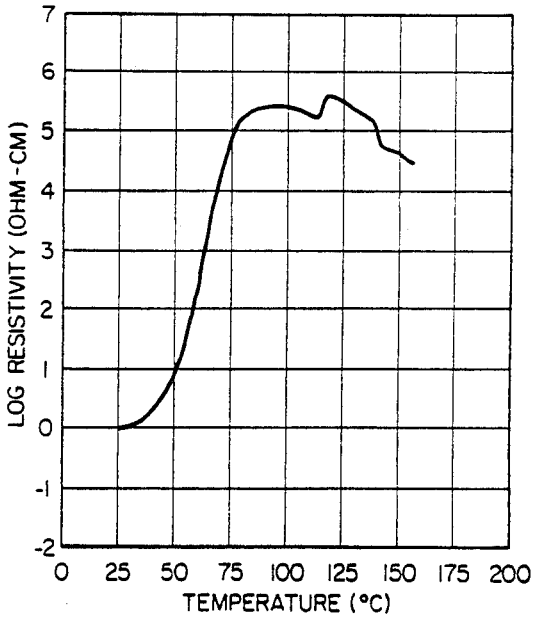
Figure 5:
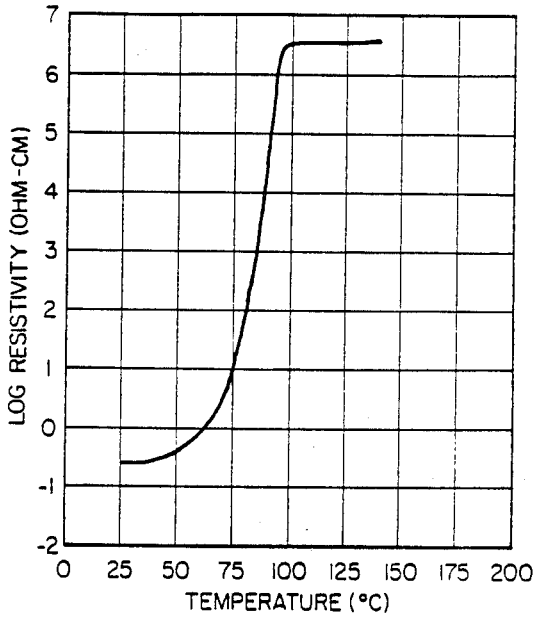
Figure 6:
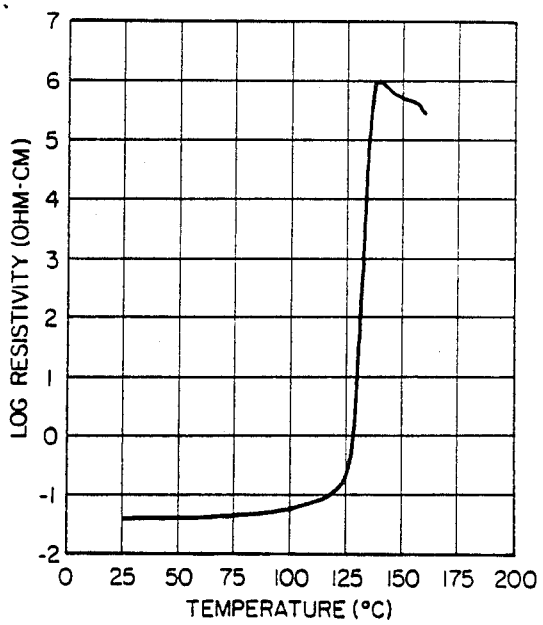
Figure 7:
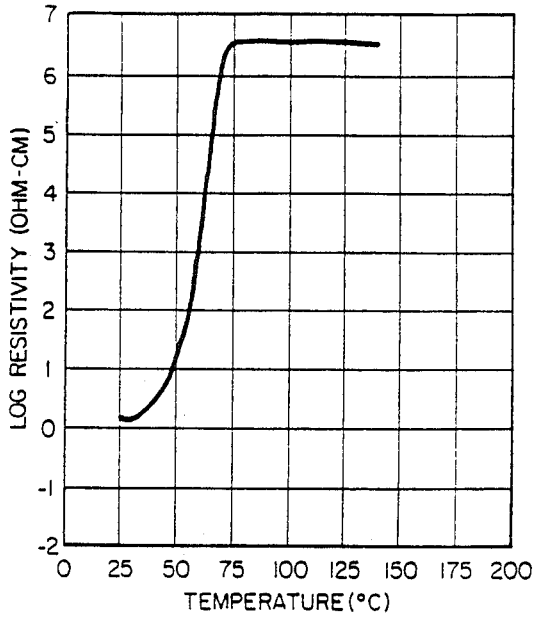
Figure 8:
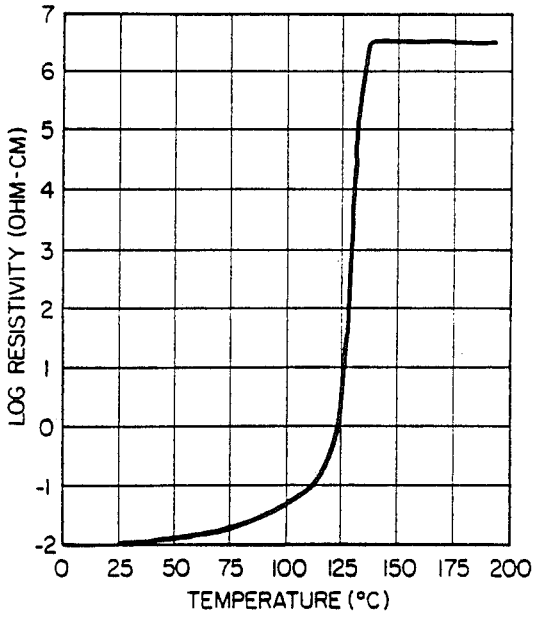

As stated above, the novel compositions of this invention exhibit PTC behavior. In general, the compositions of this invention exhibit a very sharp increase in resistivity when the temperature increases somewhat above the switching temperature. Some of the compositions of this invention show a more gradual PTC effect with the resistivity increasing at a relatively slow rate with increasing temperatures. The change in resistivity is such that the resistivity of the composition above the switching temperature is at least about 1,000 times the resistivity of the composition below the switching temperature. More specifically the ratio of the resistivity of the composition at a temperature between $T_s$ and [$T_s$+100° C.] to the resistivity of the composition at a temperature between −40° C. and $T_s$ is at least about 1,000. In preferred embodiments of the invention this ratio is at least 10,000 and especially above 100,000.

The terms PTC and PTC composition are also used in this specification to describe more generally, any composition which has an $R_{14}$ value of at least 2.5 and an $R_{100}$ value of at least 10, and preferably has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range.

The term switching temperature, $T_s$, is used in this specification to refer to the temperature at which the composition exhibits an increase in resistivity with increasing temperature. For compositions which exhibit a very sharp increase in resistivity over a relatively small temperature range, a graph plotting the log of the resistivity of the composition against the temperature of the composition will show a sharp change of slope. The switching temperature is located on such a graph at the point of intersection of the extensions of the substantially straight lines which lie either side of the sharp change in slope. In compositions which show a gradual PTC effect the switching temperature is not clearly defined in such a graph and in such cases, the switching temperature is the temperature of the composition prior to passage of an electric current therethrough.

The conductive polymer compositions of this invention preferably have a volume resistivity of from about $10^{-5}$ to about $10^5$ ohm-centimeters at a temperature in the range of from about −40° C. to $T_s$, depending on the amount and characteristics of the conductive particles used in the composition. Thus, the compositions of this invention can have significantly lower volume resistivities than the prior art carbon black containing PTC compositions. When a conductive polymer composition having extremely low resistivity is required it is preferred to use a conductive compositions containing metal particles. Metal filled compositions possess certain advantages over comparable carbon black compositions, for example, metal filled compositions generally exhibit sharper anomalous PTC effects, that is, a larger resistivity increase for a relatively small increase in temperature above the switching temperature. Typically compositions of this invention have resistivities of less than $10^3$ ohm-cm and in particular less than 10 ohm-cm. For certain uses of the compositions, for example, for use in current limiting devices in relatively high current circuits, compositions having resistivities less than from about 1 ohm-cm to about $10^{-4}$ ohm-cm should be used. Compositions having resistivities of less than about 0.1 ohm-cm or less than $10^{-2}$ ohm-cm can also be used for this purpose.

The conductive particles are dispersed in the polymer matrix preferably, in an amount of from about 10 to about 75 percent by volume, based on the total volume of the composition. Particularly preferred are compositions containing conductive particles in an amount of from about 30 to about 60 volume percent. The amount of conductive particles incorporated into the composition will depend on the desired resistivity. In general, a greater content of conductive particles in the composition will result in a lower resistivity for a particular polymeric material.

The conductive particles dispersed in the polymeric material are of a material having a volume resistivity of less than about $10^{-3}$ ohm-cm, preferably less than about $10^{-4}$ ohm-cm and in particular less than about $10^{-5}$ ohm cm. Thus, the conductive particles can be of virtually any metal. Typical metals which can be used include, for example, nickel, tungsten, molybdenum, silver, gold, platinum, iron, aluminum, copper, tantalum, zinc, cobalt, chromium, lead, titanium, and tin. Conductive particles of graphite or of an alloy such as nichrome, brass, or the like, can be used, if desired. It is preferred to use metals having a Brinell hardness of greater than 100. Particularly preferred for reasons of performance as well as for their relatively low cost are nickel, tungsten and molybdenum.

The conductive particles preferably have a particle size of about 0.01 to about 200 microns, preferably from about 0.02 to about 25 microns, particularly from about 0.1 to about 5 microns and especially from about 0.5 to about 2 microns. The particles can be of any shape such as flakes, rods, spherical particles and the like. Particularly suitable are particles which are essentially spherical.

The particulate filler can comprise conductive or non-conductive particles or mixtures thereof. Preferably, the particulate filler is selected from the group consisting of carbon black, and metal particles which have an average particle size substantially less than the average particle size of the conductive particles dispersed in the polymer matrix. By "substantially less" is meant that the average particle of the particulate filler composed of metal particles by less than the average particle size of the conductive particles by a factor of about 2 to about 10,000, preferably from about 10 to about 5,000 and particularly from about 100 to about 1000. When both the conductive particles and the particulate filler comprise metal particles, the particulate filler and conductive particles can be of the same or different metals. When the particulate filler comprises metal particles, the particles are preferably of a metal having a Brinell hardness greater than 100, in particularly particles of nickel, tungsten and molybdenum are preferred. When the particulate filler is carbon black, any conductive carbon black can be used. Preferably, the carbon black has an average particle size of from about 0.01 to about 0.07 microns. Non-conductive filler particles which can be used include alumina trihydrate, silica, glass beads, zinc sulfide and the like. The particulate filler preferably has an average particle size of about 0.001 to about 50 microns, preferably from about 0.01 to about 5 microns. When the particulate filler comprises metal particles, the average particle size of the filler should be substantially less than the average particle size of the conductive particles. When other fillers are used, the average particle size of the filler can be less, the same as, or greater than the average particle size of the conductive particles. The particulate filler is present in the composition in an amount of at least about 4 percent by volume, based on the total volume of the composition. Preferably, the particulate filler is present in an amount of from about 4 to about 50 percent by volume, particularly from about 6 to about 25 volume percent and especially from about 8 to about 20 volume percent.

The polymeric material used in preparing the conductive compositions can be a thermoplastic, an elastomer or thermosetting resin or blends thereof.

Thermoplastic polymers suitable for use in the invention, may be crystalline or non-crystalline. Illustrative examples are polyolefins, such as polyethylene or polypropylene, copolymers (including terpolymers, etc.) of olefins such as ethylene and propylene, with each other and with other monomers such as vinyl esters, acids or esters of $\alpha$, $\beta$-unsaturated organic acids or mixtures thereof, halogenated vinyl or vinylidene polymers such as polyvinyl chloride, polyvinylidene chloride, polyvinyl fluoride, polyvinylidene fluoride and copolymers of these monomers with each other or with other unsaturated monomers, polyesters, such as poly(hexamethylene adipate or sebacate), poly(ethylene terephthalate) and poly(tetramethylene terephthalate), polyamides such as Nylon-6, Nylon-6,6 Nylon-6,10 and the "Versamids" (condensation products of dimerized and trimerized unsaturated fatty acids, in particular linoleic acid with polyamines), polystyrene, polyacrylonitrile, thermoplastic silicone resins, thermoplastic polyethers, thermoplastic modified celluloses, polysulphones and the like. The thermoplastic polymer can be cross-linked if desired.

Suitable elastomeric resins include rubbers, elastomeric gums and thermoplastic elastomers. The term "elastomeric gum", refers to a polymer which is non-crystalline and which exhibits rubbery or elastomeric characteristics after being cross-linked. The term "thermoplastic elastomer" refers to a material which exhibits, in a certain temperature range, at least some elastomer properties; such materials generally contain thermoplastic and elastomeric moieties. The elastomeric resin need not be cross-linked when used in the compositions of this invention. At times, particularly when relatively low volumes of conductive particle and particulate filler are used, cross-linking may be advantageous.

Suitable elastomeric gums for use in the invention include, for example, polyisoprene (both natural and synthetic), ethylene-propylene random copolymers, poly(isobutylene), styrene-butadiene random copolymer rubbers, styreneacrylonitrile-butadiene terpolymer rubbers with and without added minor copolymerized amounts of $\alpha$, $\beta$-unsaturated carboxylic acids, polyacrylate rubbers, polyurethane gums, random copolymers of vinylidene fluoride and, for example, hexafluoropropylene, polychloroprene, chlorinated polyethylene, chlorosulphonated polyethylene, polyethers, plasticized poly(vinyl chloride) containing more than 21% plasticizer, substantially non-crystalline random co- or ter-polymers of ethylene with vinyl esters or acids and esters of $\alpha$, $\beta$-unsaturated acids. Silicone gums and base polymers, for example poly(dimethyl siloxane), poly(-methylphenyl siloxane) and poly(dimethyl vinyl siloxanes) can also be use.

Thermoplastic elastomers suitable for use in the invention, include graft and block copolymers, such as random copolymers of ethylene and propylene grafted with polyethylene or polypropylene side chains, and block copolymers of $\alpha$-olefins such as polyethylene or polypropylene with ethylene/propylene or ethylene/-propylene/diene rubbers, polystyrene with polybutadiene, polystyrene with polyisoprene, polystyrene with ethylene-propylene rubber, poly(vinylcyclohexane) with ethylene-propylene rubber, poly($\alpha$-methylstyrene) with polysiloxanes, polycarbonates with polysiloxanes, poly(tetramethylene terephthalate) with poly(tetramethylene oxide) and thermoplastic polyurethane rubbers.

Thermosetting resins, particularly those which are liquid at room temperature and thus easily mixed with the conductive particles and particulate filler can also be used. Conductive compositions of thermosetting resins which are solids at room temperature can be readily prepared using solution techniques. Typical thermosetting resins include epoxy resins, such as resins made from epichlorohydrin and bisphenol A or epichlorohydrin and aliphatic polyols, such as glycerol. Such resins are generally cured using amine or amide curing agents. Other thermosetting resins such as phenolic resins obtained by condensing a phenol with an aldehyde, e.g. phenol-formaldehyde resin, can also be used. In preparing the metal filled conductive compositions of this invention the conductive and particulate filler are incorporated into such thermosetting resins prior to cure.

Other additives can also be present in the composition. Such additives include antioxidants, fire retardants, cross-linking agents and the like.

The compositions of this invention can be prepared by conventional techniques. For example, the compositions can be prepared by melt blending the polymeric material and metal particles in a two roll mill or internal mixer such as a Brabender or Banbury mixer. If the polymeric material is a liquid at room temperature, mechanical stirring can be used.

As mentioned above, the compositions of this invention generally exhibit anomalous PTC characteristics, that is they undergo a sharp change in resistivity as the temperature is increased above a certain critical temperature usually referred to as the switching value. This very rapid and very large change in resistivity makes the compositions useful in current limiting devices.

When the temperature of such a device rises above the switching temperature the resistivity of the composition rapidly increases and reduces the current through the device. The temperature of the device might rise above the switching temperature due to current-generated heat in the device (frequently referred to as $I^2R$ heating) or by an increase in ambient temperature. The compositions of this invention can also be used for EMI shielding, self-limiting heaters, and other applications. As discussed above, the resistivity of the compositions can be as low as $10^{-5}$ ohm-centimeters depending on the amount and characteristics of metal particles incorporated into the composition. This very low resistivity makes the compositions particularly useful for controlling the current in electrical circuits which operate under conditions of a relatively high current. Unlike prior art metal-filled conductive polymer compositions, the compositions of this invention can withstand voltages above 10 volts without exploding, burning up or failing due to internal damage which is believed to be due to internal sparking or arcing. See the above-mentioned article of Littlewood et al.

COMPARATIVE EXAMPLE

To demonstrate that the composition of this invention has significantly different electrical properties than the compositions disclosed in U.S. Pat. No. 3,983,075 to Marshall et al. (U.S. Pat. No. 3,983,075) compositions were prepared, using materials and following procedures specified in the U.S. Pat. No. 3,983,075 as closely as possible. Compositions were prepared containing 28 wt. percent copper flake and 7 wt. percent carbon black (Composition A) and 50 weight percent copper flake (Composition B) dispersed in an epoxy resin matrix. Both of the compositions had high resistivities. A third composition containing 80 wt. percent copper flake dispersed in an epoxy resin (Composition C) was prepared in order to conduct the desired electrical testing. The exact compositions are as follows:

| | A (Wt %) | B (Wt %) | C (Wt %) |
|---|---|---|---|
| Copper flake | 28 | 50 | 80 |
| Carbon black | 7 | — | — |
| Epoxy Resin | 45.5 | 35 | 14 |
| Curing Agent | 19.5 | 15 | 6 |

In each case the copper flake used was Alcan MD650A, a copper flake having a particle size of 44 microns, obtained from Alcan Aluminum Corporation; the carbon black used was Vulcan XC-72, a carbon black having an average particle size of 30 millimicrons, commercially available from Cabot Corporation; the epoxy resin was Epon 828, available from Shell Chemical Co., an epoxy resin having slightly higher viscosity and epoxy equivalent weight than the epoxy resin used in the U.S. Pat. No. 3,983,075 and the curing agent was Versamid 140, a polyamide curing agent commercially available from General Mills.

The copper flake was cleaned using the procedure detailed in the U.S. Pat. No. 3,983,075. About 200 grams of copper flakes were placed in a flask and eight times the volume of the flakes (about 700–800 milliliters) of trichloroethylene was added, the mixture was stirred for 0.5 hours and then filtered in a Buchner funnel. This procedure was repeated. Then the filtered copper flakes were rinsed four times with methanol. The flakes were removed and mixed with one liter of 1M citric acid (192.14 grams/liter) for 12 hours with mechanical stirring. The mixture was filtered in a Buchner funnel, washed four times with water and twice with methanol. The copper flakes were then dried in a vacuum oven at 100° F.

The copper flakes (Compositions B and C) or copper flakes and carbon black (Composition A) were mixed with the resin until the mixture was uniform and then the mixture was placed on a water-cooled, three inch roll mill. After two or three minutes the curing agent was added. Mixing was continued for several more minutes. The mixture was cast onto a sheet of polytetrafluoroethylene, covered with a second sheet of polytetrafluoroethylene and light pressure applied to provide a conductive polymer sheet of uniform thickness. The compositions were then cured at 70° F. for 16 hours, as specified in the U.S. Pat. No. 3,983,075. However, curing of the samples under these conditions was found to be inadequate. Adequate curing was obtained by placing the compositions in an oven at 150° F. for 2–3 hours.

Figure 9:
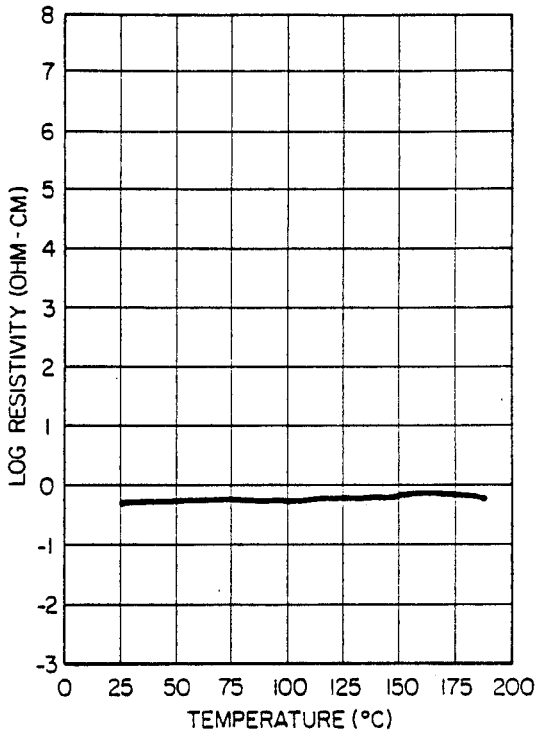
FIG 9 PRIOR ART
FIG. 9 shows the resistivity-temperature characteristics of the composition of the comparative example below which is a duplication of the compositions disclosed in U.S. Pat. No. 3,983,075.

Following cure, a 1"×1½" slab of each composition was cut from cured epoxy resin composition and painted with a ¼ inch strip of silver paint along the edges to provide a 1"×1" area. The resistance of each sample was measured over a range of increasing temperatures and the resistivity calculated from the resistance value. None of the samples examined showed a sharp increase in resistivity from below 10 ohm-cm. to above 1000 ohm-cm. As shown in FIG. 9, the compositions showed minimal increase in resistivity with temperature.

EXAMPLES

Conductive compositions comprising various polymeric materials, metal particles and a second particulate filler were prepared on either a three-inch roll mill, a Brabender or Banbury mixer by the procedures described below. The ingredients used in preparing each composition and the amounts thereof are listed in the accompanying Table.

Mixing Procedure Using Mill

The polymer was placed on a 3" electric mill previously heated to about 25°–40° C. above the polymer melting point, and allowed to melt and band onto the roll. Antioxidant was added and allowed to disperse. Metal particles and the particulate filler were slowly added, by portions, and allowed to mix in a manner such that the metal particles did not come into contact with the rolls and thereby cause the polymer to disband. The composition was worked until uniform and then was milled about three more minutes. The final composition was removed from the mill in sheets and allowed to cool before being compression molded in slabs.

Mixing Procedure Using Brabender Mixer

The cavity was heated to the process temperature for the polymer about 20°–40° C. above the polymer melting point. With the speed of the rotors at 20 rpm the plastic, in pellet form, was added and mixed until melted. The non-conductive additives, i.e. antioxidant and non-conductive particulate filler, were then poured in and mixed until uniform. In small increments the metal particles and particulate filler, if conductive, were added. When all ingredients were mixed in the rotor, speed was increased to 60 rpm and the composition was mixed for about 2 minutes. The Brabender was turned off, the material scraped from the blades and walls, and allowed to cool. The composition was then compression molded into slabs.

Mixing Procedure Using Banbury Mixer

The body of the mixer was preheated with steam to a temperature of 150°-180° C. With the speed at ~500 RPM the polymer and antioxidant were introduced into the mixer. When the polymer began to flux, as indicated by the vibration of the ram, the filler was added by portions, maintaining a constant temperature. With the ram down the composition was mixed for 5 minutes, then dumped, cooled, and granulated. The granules were then compression molded into slabs or extruded into tape.

Electrical Stability Test

Some of the compositions, as indicated in the Table, were tested for electrical stability by the following test procedure in which transient currents in the conductive composition were observed using an oscilloscope. The transient currents which appear on the current trace on the oscilloscope are believed to be evidence of internal arcing and sparking in the composition which can lead to tracking and short circuiting of an electrical device made from the composition. A ¼ inch wide strip of a conductive silver paint was applied along each edge of a 1½ inch by ¼ inch rectangle of the metal filled conductive polymer composition to provide a test area 1 inch by ¼ inch. The sample was inserted into a circuit which also contained a one ohm resistor. A 60 hertz signal was produced by an audio signal generator, amplified and transformed to give a 120 volt, 4 amp signal free from mains distortion. A variac was used to vary the voltage from 0-140 volts. The variac was adjusted to the desired voltage and this voltage was applied to the test circuit. The voltage measured across the device and the 1 ohm resistor are monitored on an oscilloscope. Current transients, observed as sharp random spikes on the current trace, are indications of electrical instability of the sample.

Using the variac, the voltage was slowly increased from zero volts and turned up to 10 V. Following a 5 minute observation period, the voltage was increased to 20 V and maintained at that value for an additional 5 minute observation period. Similar waiting periods were maintained and observed at 60 V and 120 V. If no current transients were visible during any of these periods, the sample is reported in Table I to be electrically stable.

In addition to the electrical stability tests, the electrical resistance of each of the compositions of Examples 1-8 was measured as the temperature was gradually increased. The resistivities were calculated from these measurements. Graphs were prepared of a plot of the log of the resistivity against the temperature for each composition of Examples 1-8 are shown in FIGS. 1-8 respectively. As can be readily seen by these graphs, the compositions show a sharp increase in resistivity when the temperature rises above a certain value, referred to herein as the switching temperature, $T_S$. In each graph, the horizontal line at the top of the graph merely represents the upper limit of the apparatus used.

In the Table the polymeric materials used are indicated by the abbreviations:

HDPE—high density polyethylene (Phillips Marlex 6003)

LDPE—low density polyethylene (Union Carbide DYNH-1)

MDPE—medium density polyethylene (Gulf 2604M)

EEA—ethylene-ethyl acrylate copolymer (Union Carbide DPD 6169)

EAA—ethylene-acrylic acid copolymer (Dow Chemical Co. EAA 455)

FEP—hexafluoroethylene-tetrafluoroethylene copolymer (Du Pont FEP100)

The metals used in each example with the appropriate average particle size and the particulate filler with the average particle size of that filler are shown in the Table.

TABLE

| Example | Polymer (Vol. %) | Metal (Vol. %) | Filler (Vol. %) | Electrically Stable | Additives (Vol %) | Resistivity Ratio |
|---|---|---|---|---|---|---|
| 1 | HDPE (52.1%) | Ni flake (47.0%) | — | No | AO (0.9%) | $10^6$ |
| 2 | HDPE (54%) | Nickel (35%) (2.2-3.0μ) | Molybdenum (10%) (0.3-.06μ) | Yes | AO (1%) | $10^6$ |
| 3 | HDPE (49%) | Tungsten (45%) (.56μ) | Tungsten (5%) (0.3-.06μ) | Yes | AO (1%) | $10^5$ |
| 4 | EEA (47.9%) | Nickel (36%) (2.2-3.0μ) | Carbon black (14.1%) (.03μ) | Yes | ZnS (1%) AO (0.9%) | $10^5$ |
| 5 | EAA (51.4%) | Nickel (35.8%) (2.2-3.0μ) | Carbon black (11.9%) (.06μ) | Yes | AO (0.9%) | $10^7$ |
| 6 | HDPE (51.4%) | Nickel (35.8%) (2.2-3.0μ) | Carbon black (11.9%) (.06μ) | Yes | AO (0.9%) | $10^6$ |
| 7 | EEA (51.4%) | Nickel (35.8%) (2.2-3.0μ) | Carbon black (11.9%) (.06μ) | Yes | AO (0.9%) | $10^6$ |
| 8 | HDPE (15%) Polypropylene (35%) | Nickel (43.2%) (2.2-3.0μ) | Carbon black (4.8%) (0.25μ) | — | AO (2%) | $10^7$ |
| 9 | HDPE (48%) | Nickel (45%) (2.2-3.0μ) | Carbon black (5%) (0.25μ) | — | AO (2%) | $10^3$ |
| 10 | LDPE (55.6%) | Nickel (39.1%) (2.2-3.0μ) | Carbon black (4.3%) (.06μ) | — | AO (1%) | $10^7$ |
| 11 | FEP (56.6%) | Nickel (39.1%) (2.2-3.0μ) | Carbon black (4.3%) (.06μ) | — | — | $>10^7$ |

TABLE-continued

| Example | Polymer (Vol. %) | Metal (Vol. %) | Filler (Vol. %) | Electrically Stable | Additives (Vol %) | Resistivity Ratio |
|---|---|---|---|---|---|---|
| 12 | MDPE (64.0%) | Nickel (11.3%) (2.2-3.0μ) | Carbon black (22.6%) (.06μ) | — | AO (2%) | $10^6$ |
| 13 | Polycaprolactone (64.0%) | Nickel (11.3%) (2.2-3.0μ) | Carbon black (22.6%) (.06μ) | — | AO (2%) | $10^6$ |
| 14 | EEA (44.8%) | Nickel (40%) (2.2-3.0μ) | Carbon black (13.2%) (.03μ) | Yes | AO (2%) | $10^4$ |
| 15 | EAA (51.4%) | Nickel (42.9%) (2.2-3.0μ) | Hydral (4.8%) | Yes | AO (0.9%) | $>10^4$ |
| 16 | EAA (53.9%) | Nickel (34.3%) (2.2-3.0μ) | Cab-o-sil (11.1%) | Yes | AO (0.7%) | $>10^3$ |
| 17 | EEA (51.4%) | Nickel (42.9%) (2.2-3.0μ) | Glass beads (4.8%) | Yes | AO (0.9%) | $>10^4$ |
| 18 | EEA (51.4%) | Nickel (35.8%) (2.2-3.0μ) | Glass beads (11.9%) | Yes | AO (0.9%) | $>10^4$ |
| 19 | Epon 828 (43.6%) Versamid 140 (22.4%) | Copper Flake (34.0%) | — | No | — | 1 |

AO represents an antioxidant, which comprises an oligomer of 4,4'-thiobis (3-methyl-6t-butyl phenol) with an average degree of polymerization of 3-4, as described in U.S. PAT. NO. 3,986,981.
Hydral is alumina trihydrate, with most of the particles being in the range of 0.0005-2μ, available from Alcoa
Cab-o-sil is particulate silica with most of the particles being in the range of 0.007-0.016μ, available from Cabot Corporation
Glass beads had a particle size in the range of .004-44μ, available from Potters Industries

What is claimed is:

1. A conductive polymer composition which exhibits PTC behavior with a switching temperature $T_s$ and which comprises:
   (1) an organic polymeric material which comprises a crystalline, thermoplastic polymer, and
   (2) dispersed in said polymeric material a filler component which comprises
      (a) at least about 10% by volume, based on the total volume of the composition of a first conductive particulate filler which has a first particle size $D_1$ from 0.01 to 200 microns and which consists of a metal having a resistivity at 25° C. of less than $10^{-3}$ ohm. cm; and
      (b) at least 4% by volume, based on the total volume of the composition, of a second particulate filler which has a second average particle size $D_2$ from 0.001 to 50 microns and which is composed of non-metallic material;

said composition having a resistivity at 25° C, $\rho_{25}$, of less than $10^5$ ohm-cm and a resistivity at a temperature in the range $T_s$ to $(T_s+100)$°C. which is at least $1000\times\rho$Hd 25.

2. A composition in accordance with claim 1 wherein $\rho_{25}$ is less than 10 ohm.cm.

3. A composition in accordance with claim 1 wherein said composition has a volume resistivity of less than 1 ohm-cm at a temperature in the range of from about −40° C. to $T_s$, where $T_s$ is the switching temperature of the composition.

4. A composition in accordance with claim 1 wherein $\rho_{25}$ is less than 0.1 ohm.cm.

5. A composition in accordance with claim 1 which has a resistivity at a temperature in the range of $T_s$ to $(T_s+100)$°C. which is at least $10{,}000\times\rho_{25}$.

6. A composition in accordance with claim 1 wherein the first particulate filler is composed of a metal selected from the group consisting of nickel, tungsten, molybdenum, iron, chromium, aluminum, copper, silver, gold, platinum, tantalum, zinc, cobalt, brass, tin, titanium and nichrome.

7. A composition in accordance with claim 1 wherein the first particulate filler is composed of a metal selected from the group consisting of nickel, tungsten and molybdenum.

8. A composition in accordance with claim 1 wherein the first particulate filler is composed of nickel.

9. A composition in accordance with claim 1 wherein $D_1$ is 0.01 to 25 microns.

10. A composition in accordance with claim 9 wherein $D_1$ is 0.02 to 25 microns.

11. A composition in accordance with claim 10 wherein $D_1$ is 0.5 to 5 microns.

12. A composition in accordance with claim 11 wherein $D_1$ is 0.5 to 2 microns.

13. A composition in accordance with claim 1 wherein the first particulate filler is present in an amount from 10 to 60 volume %, based on the total volume of the composition.

14. A composition in accordance with claim 13 wherein the first particulate filler is present in an amount from 30 to 60 volume % based on the total volume of the composition.

15. A composition in accordance with claim 1 wherein the second particulate filler is composed of a non-metallic conductive material.

16. A composition in accordance with claim 1 wherein the second particulate filler is a carbon black.

17. A composition in accordance with claim 1 wherein the second particulate filler is a graphite.

18. A composition in accordance with claim 1 wherein the second particulate filler is composed of non-conductive particles.

19. A composition in accordance with claim 1 wherein $D_2$ is substantially less than $D_1$.

20. A composition in accordance with claim 1 wherein $D_2$ is substantially less than $D_1$.

21. A composition in accordance with claim 1 wherein $D_2$ is 0.001 to 50 microns.

22. A composition in accordance with claim 1 wherein $D_2$ is 0.01 to 5 microns.

23. A composition in accordance with claim 1 wherein the second particulate filler is present in an amount from 4 to 50 volume %, based on the total volume of the composition.

24. A composition in accordance with claim 23 wherein the second particulate filler is present in an amount from 6 to 25 volume %, based on the total volume of the composition.

25. A composition in accordance with claim 1 wherein said thermoplastic polymer is selected from the group consisting of polyethylene, polypropylene, copolymers of ethylene with ethyl acrylate or acrylic acid, polyvinylidene fluoride, tetrafluoroethylene-hexafluoropropylene copolymers and mixtures thereof.

26. A composition in accordance with claim 1 wherein said polymeric material is cross-linked.

27. A composition in accordance with claim 1 wherein said polymeric material comprises elastomeric gum.

28. A composition in accordance with claim 27 wherein said polymeric material comprises a silicone rubber.

29. An electrical device which comprises at least one electrode in electrical contact with a conductive polymer composition in accordance with claim 1.

30. An electrical device in accordance with claim 29 wherein said device is a heater.

31. A current limiting device which comprises two electrodes in contact with a conductive polymer composition in accordance with claim 1.

32. An electromagnetic interference shield comprising a conductive polymer composition in accordance with claim 1.

33. A composition according to claim 19 wherein $D_1$ is 100 to 1000 times $D_2$.

34. A conductive polymer composition which exhibits PTC behavior with a switching temperature $T_s$ and which comprises (1) an organic polymeric material which comprises a crystalline thermoplastic polymer, and (2) dispersed in said polymeric material, a filler component which comprises (a) at least 10% by volume, based on the total volume of the composition, of a first conductive particulate filler which has a first average particle size, $D_1$, from 0.01 to 200 microns and which consists of a metal having a resistivity at 25° C. of less than $10^{-3}$ ohm.cm; and (b) at least 4% by volume, based on the total volume of the composition, of a second conductive particulate filler which (i) has a second average particle size $D_2$, which is less than $0.5 \times D_1$ and is from 0.001 to 50 microns and (ii) consists of a metal having a resistivity at 25° C. of less than $10^{-3}$ ohm.cm;

the composition having a resistivity at 25° C., $\rho_{25}$, of less than $10^5$ ohm.cm and a resistivity at a temperature in the range $T_s$ to $(T_s+100)$°C. which is at least $1000 \times \rho_{25}$.

35. A composition according to claim 34 wherein the first and second fillers are composed of different metals.

36. A composition according to claim 34 wherein $D_1$ is from 10 to 5,000 times $D_2$.

37. A composition according to claim 36 wherein $D_1$ is from 100 to 1,000 times $D_2$.

38. A composition according to claim 34 wherein the first and second particulate fillers are composed of a metal selected from the group consisting of nickel, tungsten, molybdenum, iron, chromium, aluminum, copper, silver, gold, platinum, tantalum, zinc, cobalt, brass, tin, titanium and nichrome.

39. A composition according to claim 38 wherein at least one of the particulate fillers is composed of a metal selected from the group consisting of nickel, tungsten and molybdenum.

40. A composition according to claim 34 wherein $\rho_{25}$ is less than 10 ohm.cm.

41. A composition according to claim 34 wherein $\rho_{25}$ is less than 0.1 ohm.cm.

42. A composition according to claim 34 which has a resistivity in the temperature range $T_s$ to $(T_s100)$°C. which is at least 10,000 times $\rho_{25}$.

43. A composition according to claim 34 wherein $D_1$ is from 0.1 to 25 microns.

44. A composition according to claim 43 wherein $D_1$ is from 0.5 to 5 microns.

45. A composition according to claim 34 which contains 30 to 60% by volume of the first filler and 6 to 25% by volume of the second filler.

46. A composition in accordance with claim 6 wherein the second particulate filler is selected from the group consisting of carbon black and graphite.

47. A composition in accordance with claim 6 wherein the second particulate filler is selected from the group consisting of alumina trihydrate, silica, glass beads and zinc sulfide.

48. A composition according to claim 34 wherein the organic polymeric material also comprises an elastomer.

49. A composition according to claim 1 wherein the organic polymeric material also comprises an elastomer.

* * * * *